US005501820A

United States Patent [19]

van den Bergh et al.

[11] Patent Number: 5,501,820

[45] Date of Patent: Mar. 26, 1996

[54] AQUEOUS ENZYMATIC DETERGENT COMPOSITIONS

[75] Inventors: Carlo J. van den Bergh, Rotterdam, Netherlands; Howard B. Kaiserman, Guttenberg, N.J.; Marja Ouwendijk, Hellevoetsluis, Netherlands

[73] Assignee: Lever Brothers Company, Division of Conopco, Inc., New York, N.Y.

[21] Appl. No.: 210,264

[22] Filed: Mar. 17, 1994

Related U.S. Application Data

[63] Continuation of Ser. No. 964,534, Oct. 14, 1992.

[30] Foreign Application Priority Data

Oct. 16, 1991 [EP] European Pat. Off. ..... 91202692

[51] Int. Cl.[6] ..... C11D 3/386; C11D 1/04; C11D 1/12

[52] U.S. Cl. ..... 252/549; 252/174.12; 252/DIG. 12; 252/554; 252/555; 252/174.16

[58] Field of Search ..... 435/219–225; 252/174.12, DIG. 12, 549, 554, 555, 174.16

[56] References Cited

U.S. PATENT DOCUMENTS

| | | | |
|---|---|---|---|
| 4,537,707 | 8/1985 | Severson et al. | 252/545 |
| 4,760,025 | 7/1988 | Estell et al. | 252/174.12 |
| 5,030,378 | 7/1991 | Venegas | 252/174.12 |
| 5,071,586 | 12/1991 | Kaiserman et al. | 252/174.12 |
| 5,147,576 | 9/1992 | Montague et al. | 252/174 |
| 5,178,789 | 1/1993 | Estell | 252/174.12 |
| 5,346,823 | 9/1994 | Estell et al. | 435/222 |
| 5,389,307 | 2/1995 | Lindegaard | 252/549 |

FOREIGN PATENT DOCUMENTS

| | | |
|---|---|---|
| 89/06279 | 1/1989 | WIPO . |
| 8906279 | 7/1989 | WIPO . |
| 9014420 | 11/1990 | WIPO . |
| 9100345 | 1/1991 | WIPO . |
| 9116423 | 10/1991 | WIPO . |
| 92/08779 | 3/1992 | WIPO . |
| 9211348 | 7/1992 | WIPO . |
| 9219729 | 11/1992 | WIPO . |

OTHER PUBLICATIONS

The Biopaper Journal, vol. 10, Issue 5, Nov./Dec. 1990.
Products Application Sheet for Enzymes.
Product–Application Sheet for Durazym (no date on paper.

*Primary Examiner*—Paul Lieberman
*Assistant Examiner*—Kery Fries
*Attorney, Agent, or Firm*—Ronald A. Koatz

[57] ABSTRACT

A stable aqueous enzymatic detergent composition comprising:

(a) from about 5 to about 65% by weight of a surfactant;

(b) a mutant subtilisin enzyme in which the amino acid sequence has been changed at least at positions 195 and 222 by substitution with another amino acid, said enzyme being added in sufficient quantity to have an activity level of 0.01 to 200,000 GU/g;

said composition being essentially free from bleaching agents and/or comprising (c) a further enzyme selected from the group consisting of lipases, amylases and cellulases.

7 Claims, No Drawings

AQUEOUS ENZYMATIC DETERGENT COMPOSITIONS

This is a continuation application of Ser. No. 07/964,534, filed Oct. 14, 1992.

FIELD OF THE INVENTION

This invention relates to the field of aqueous enzymatic detergent compositions. More in particular, it relates to aqueous enzymatic detergent compositions containing mutant protease enzymes which provide enhanced enzyme stability.

BACKGROUND AND PRIOR ART

The use of proteases in heavy duty liquid detergent formulations is complicated by their limited stability in solution. Two processes which limit the shelf-life of a protease in an aqueous liquid detergent are denaturation and autolysis (self-digestion). Considerable efforts have been devoted to the stabilization of enzymes in aqueous liquid detergent compositions, which represent a medium that is problematical for the preservation of enzyme activity during storage and distribution.

Denaturation of proteases may be minimized by selection of optimal formulation components such as actives, builders, etc., and conditions such as pH, so that acceptable enzyme stability is achieved. Self-digestion of proteases may be minimized by inclusion of a protease inhibitor. The inhibitor is released from the enzyme upon dilution in the wash and the proteolytic activity is restored.

Various protease inhibitors are known in the art. For example, U.S. Pat. No. 4,261,868 (Unilever) teaches the use of borax as a protease inhibitor and both U.S. Pat. No. 4,243,546 (Drackett) and GB-A-1 354 761 (Henkel) teach the use of carboxylic acids as protease inhibitors. Various combinations of these protease inhibitors are also known in the art. U.S. Pat. No. 4,305,837 (Procter & Gamble), for example, teaches the combination of carboxylic acids and simple alcohols and U.S. Pat. No. 4,404,115 (Unilever) teaches the combination of borax and polyols as protease inhibitors. U.S. Pat. No. 4,537,707 (Procter & Gamble) teaches the combination of borax and carboxylates as protease inhibitors.

It is also known to use mutant subtilisin proteases which have been modified by substitution at an amino acid site. U.S. Pat. No. 4,760,025 (Genencor), for example, claims subtilisin mutants with amino acid substitutions at amino acid sites 32, 155, 104, 222, 166, 64, 33, 169, 189, 217 or 157 which are different from subtilisins naturally produced by *B. amyloliquefaciens*. A mutant protease whereby methionine at position 222 has been replaced by alanine, is shown to have an improved oxidation stability in the presence of bleach.

WO-A-89/06279 (Novo/Nordisk) discloses subtilisin mutants having modified chemical characteristics. In particular it is shown that a subtilisin mutant which has been modified at positions 195 and/or 222 exhibit an enhanced oxidation stability in the presence of peracetic acid. In a publication from Novo/Nordisk in "Biopapers Journal" Vol. 10, Issue 5 november/december 1990, page 11–14, it is disclosed that the commercially available protease Durazym is an engineered Savinase protease made by changing glycine 195 to glutamic acid and methionine 222 to alanine in the protease.

We have now surprisingly found that the mutant subtilisin enzymes which have been modified at positions 195 and 222 are of exceptional value for formulating stable, liquid detergent compositions. First, they are remarkably stable in the absence of any bleaching agent, and secondly, they are remarkably compatible with any other enzymes present in the composition, such as lipase or amylase.

WO-A-87/04461 (Amgen) discloses the substitution in Bacillus subtilisins of alternative amino acids (i.e. serine, valine, threonine, cysteine, glutamine and isoleucine) for ASN, GLY or ASN-GLY sequences (specifically at position 218). These mutations are said to increase the stability of the enzyme at high temperatures or over a broader pH range than the wild type enzyme. WO-A-88/08033 (Amgen) claims mutations which modify calcium-binding capacity (to replace an amino acid with a negatively charged residue such as ASP or GLU) and optionally a deletion and/or replacement of either residue of ASN-GLY sequences which results in better pH and thermal stability and higher specific activities. The reference claims that sites 41, 75, 76, 77, 78, 79, 80, 81, 208, and 214 may be replaced by a negatively charged amino acid and ASN may be replaced by SER, VAL, THR, CYS, GLU, or ILE in ASN-GLY sequences.

These references do not disclose detergent compositions comprising the subtilisin mutants of the subject invention or the advantages provided by the use of these mutants in these detergent compositions.

WO-A-89/06279 (Novo/Nordisk) discloses the subtilisin mutants which are used in the liquid detergent compositions of the present invention. Although the use of such mutants in bleach containing washing preparations is disclosed (Table VI), there is no teaching of the use of these mutants in detergent composition which do not contain any bleaching agents. To the contrary, the skilled man would not be inclined to make use of such mutants applications where oxidation stability does not seem to offer any advantages, because in general the proteolytic activity of the mutants is lower than that of the native enzyme. Consequently, there is no disclosure of the use of these mutants in specific detergent compositions and no teaching or disclosure that the mutant enzymes will have enhanced stability in these specifically defined compositions.

Furthermore, it is known that lipase has a tendency to be less stable in the presence of protease than in the absence of protease; surprisingly, it now was found that the mutant subtilisin enzymes of the present invention are remarkably more compatible with lipase enzyme than wild-type subtilisin enzyme.

Finally, it was found that the mutant subtilisin enzymes of the present invention are remarkably more compatible with amylase enzyme than wild-type subtilisin enzyme.

DEFINITION OF THE INVENTION

Accordingly, the present invention provides a stable aqueous enzymatic detergent composition comprising:

(a) from about 5 to about 65% by weight of a surfactant;

(b) a mutant subtilisin enzyme in which the amino acid sequence has been changed at least at positions 195 and 222 by substitution with another amino acid, said enzyme being added in sufficient quantity to have an activity level of 0.01 to 200,000 GU/g;

said composition being essentially free from bleaching agents and/or comprising (c) a further enzyme selected from the group consisting of lipases, amylases and cellulases.

DETAILED DESCRIPTION OF THE INVENTION

Detergent Active

The compositions of the invention comprise from about 5% to about 65% by weight of (a) anionic surfactant or (b) anionic surfactant and one or more detergent actives wherein the ratio of anionic to non-anionic by weight is greater than 1:1.

The detergent active material other than anionic surfactant may be an alkali metal or alkanolamine soap or a 10 to 24 carbon atom fatty acid, including polymerized fatty acids, or a nonionic, cationic, zwitterionic or amphoteric synthetic detergent material, or mixtures of any of these.

Examples of the anionic synthetic detergents are salts (including sodium, potassium, ammonium and substituted ammonium salts such as mono-, di- and triethanolamine salts of $C_9$–$C_{20}$ alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g. as described in GB-A-1 082 179, $C_8$–$C_{22}$ alkylsulphates, $C_8$–$C_{24}$ alkylpolyglycolether-sulphates, -carboxylates and -phosphates (containing up to 10 moles of ethylene oxide); further examples are described in "Surface Active Agents and Detergents" (Vol. I and II) by Schwartz, Perry and Berch. Any suitable anionic may be used and the examples are not intended to be limiting in any way.

Examples of nonionic synthetic detergents which may be used with the invention are the condensation products of ethylene oxide, propylene oxide and/or butylene oxide with $C_8$–$C_{18}$ carbon alkylphenols, $C_8$–$C_{18}$ primary or secondary aliphatic alcohols, $C_8$–$C_{18}$ fatty acid amides; further examples of nonionics include tertiary amine oxides with one 8 to 18 carbon alkyl chain and two 1 to 3 carbon alkyl chains. The above reference also describes further examples of nonionics. The above reference also describes further examples of nonionics.

Mixtures of various nonionics, including mixtures of nonionics with a lower and a higher degree of alkoxylation, may also be used. Preferred are ethoxylated $C_{12}$–$C_{15}$ fatty alcohols having 3–9 EO-groups, 5–7 EO-groups being especially preferred.

Examples of cationic detergents are the quaternary ammonium compounds such as alkyldimethylammonium halogenides. Examples of amphoteric or zwitterionic detergents which may be used with the invention are N-alkylamino acids, sulphobetaines, condensation products of fatty acids with protein hydrolysates; but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with an anionic and/or nonionic synthetic detergent.

Among the compositions of the present invention are aqueous liquid detergents having for example a homogeneous physical character, e.g. they can consist of a micellar solution of surfactants in a continuous aqueous phase, so-called isotropic liquids.

Alternatively, they can have a heterogeneous physical phase and they can be structured, for example they can consist of a dispersion of lamellar droplets in a continuous aqueous phase, for example comprising a deflocculating polymer having a hydrophillic backbone and at least one hydrophobic side chain, as described in EP-A-346 995 (Unilever) (incorporated herein by reference). These latter liquids are heterogeneous and may contain suspended solid particles such as particles of builder materials e.g. of the kinds mentioned below.

Builders

The compositions of the invention may further contain a builder. Suitable builders include conventional alkaline detergency builders, inorganic or organic, which can be used at levels from about 0.5% to about 50% by weight of the composition, preferably from 3% to about 35% by weight. More particularly, when non-structured compositions are used, preferred amounts of builder are 3 to 10% and when structured compositions are used, preferred amounts of builder are 5%–35% by weight.

By structured liquid composition is meant a composition in which at least some of the detergent active forms a structured phase. Preferably such structured phase is capable of suspending a solid particulate material.

More particularly, when a structured liquid is contemplated, the composition requires sufficient electrolyte to cause the formation of a lamellar phase by the surfactant to endow solid suspending capability. The selection of the particular type(s) and amount of electrolyte to bring this into being for a given choice of surfactant is effected using methodology very well known to those skilled in the art. It utilizes the particular techniques described in a wide variety of references. One such technique entails conductivity measurements. The detection of the presence of such a lamellar phase is also very well known and may be effected by, for example, optical and electron microscopy or X-ray diffraction, supported by conductivity measurement.

As used herein, the term electrolyte means any water-soluble salt. The amount of electrolyte should be sufficient to cause formation of a lamellar phase by the surfactant to endow solid suspending capability. Preferably, the composition comprises at least 1.0% by weight, more preferably at least 5.0% by weight, most preferably at least 17.0% by weight of electrolyte. The electrolyte may also be a detergency builder, such as the inorganic builder sodium tripolyphosphate, or it may be a non-functional electrolyte such as sodium sulphate or chloride. Preferably, the inorganic builder comprises all or part of the electrolyte.

Such structured compositions are capable of suspending particulate solids, although particularly preferred are those systems where such solids are actually in suspension. The solids may be undissolved electrolyte, the same as or different from the electrolyte in solution, the latter being saturated in electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used (in structured or unstructured compositions) are water-soluble alkalimetal phosphates, polyphosphates, borates, silicates and also carbonates. specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethane diphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid.

Certain zeolites or aluminosilicates can be used. One such aluminosilicate which is useful in the compositions of the invention is an amorphous water-insoluble hydrated compound, said amorphous material being characterized by a Mg++ exchange capacity of from about 50 mg eq. $CaCO_3$/g and a particle diameter of from about 0.01 micron to about 5 microns. This ion-exchange builder is more fully described in GB-A-1 470 250.

A second water-insoluble synthetic aluminosilicate ion exchange material useful herein is crystalline in nature and has the formula $Na_z[(AlO_2)_y.(SiO_2)].xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in GB-A-1 429 143.

The Mutant Subtilisin Enzyme

The mutant subtilisin enzymes used in the liquid detergent compositions of the invention are disclosed in WO-A-89/06279 (Novo/Nordisk). They differ from the native subtilisin enzyme in that they contain a different amino acid at positions 195 and 222 than the native enzyme. The native enzyme contains a glycine residue at position 195 and a methionine at position 222. Particularly preferred is the mutant enzyme which contains a glutamic acid residue at position 195 and a alanine residue at position 222. Of course, further advantageous mutations may be present in the enzyme.

The amount of proteolytic enzyme included in the composition ranges from 0.01 to 200,000 GU/g, preferably from 1 to 100,000 GU/g, most preferably from 1000 to 50,000 GU/g, based on the final composition.

A GU is a glycine unit, which is the amount of proteolytic enzyme which under standard incubation conditions produces an amount of terminal $NH_2$-groups equivalent to 1 microgramme/ml of glycine.

Naturally, the mutant protease in accordance with the present invention may be used in admixture with different further proteolytic enzymes. Further subtilisin proteases can be of vegetable, animal or microorganism origin. Preferably, it is of the latter origin, which includes yeasts, fungi, moulds and bacteria. Particularly preferred are bacterial subtilisin type proteases, obtained from e.g. particular strains of *B. subtilis* and *B. licheniformis*. Examples of suitable commercially available proteases are Alcalase, Savinase, Esperase, all of Novo/Nordisk A/S; Maxatase and Maxacal of Gist-Brocades; Kazusase of Showa Denko; Subtilisin BPN' proteases and so on.

The proteolytic enzymes are usually added in the form of concentrated aqueous solutions. However, as described in our copending European patent application 91200677.2 or U.S. patent application Ser. No. 681,025 (incorporated herein by reference), even further improved enzyme stability can be achieved when the enzyme is added to the formulation as a slurry of the enzyme in a nonionic detergent which is normally liquid.

The enzyme slurry contains the enzyme in the dispersed form of e.g. powder or particles suspended in a non-aqueous (nonionic) liquid surfactant, especially one which is substantially anhydrous. The enzyme particles may for example be spray-dried or lyophilized, and can for example be milled after spray-drying and before dispersion in (e.g. anhydrous) nonionic liquid detergent. Alternatively, they may be milled after dispersing the enzyme in the nonionic detergent.

The enzyme level in the slurry can be from about 0.5 to about 50% by weight, e.g. from about 1 to about 20% by weight. Commonly the enzyme slurry which is used in the manufacture of the compositions of the present invention is substantially anhydrous, with water content less than about 10%, preferably less than about 5% w/w, sometimes less than about 1%. Using this slurry technique it is possible to use a practically anhydrous liquid nonionic surfactant as the continuous phase of the slurry. The liquid state of the slurry enables a thorough mixing of the enzyme in the final liquid detergent, and allows easy liberation of the enzyme after dilution of the liquid detergent in the wash liquor.

Other Enzymes

The compositions of the invention may also contain other enzymes in addition to the proteases of the invention such as lipases, amylases and cellulases. When present, the enzymes may be used in an amount from 0.001% to 5% of the compositions.

When the compositions comprise lipolytic enzyme or lipase, the amount of lipase can be chosen within wide limits, between 10 to 30,000 LU/g of the detergent composition, e.g. often at least 100 LU/g, preferably within the range of 200 to 5000 LU/g. In this context, lipase units are defined as in EP-A-258 068 (Novo/Nordisk).

The lipase can be chosen form among a wide range of lipases: in particular the lipases described in the following patent specifications: EP-A-214 761 (Novo/Nordisk), EP-A-258 068 (Novo/Nordisk) and EP-A-305 216 (Novo/Nordisk), and especially lipases showing immunological cross-reactivity with antisera raised against lipase from *Thermomyces lanuginosus* ATCC 22070; lipases as described in EP-A-205 208 and EP-A-206 930 (Unilever); lipases showing immunological cross-reactivity with antisera raised against lipase from *Chromobacter viscosum* var lipolyticum NRRL B-3673, or against lipase from Alcaligenes PL-679, ATCC 31371 and FERM-P 3783; also the lipases described in WO-A-87/00859 (Gist Brocades) and EP-A-204 284 (Sapporo Breweries). Suitable in particular are for example lipases corresponding to the following commercially available lipase preparations: Novo/Nordisk Lipolase, Amano lipases CE, P, B, AP, M-AP, AML and CES and Meito lipases MY-30, OF and PL and also esterase MM, Lipozym, SP 225, SP 285, Saiken lipase, Enzeco lipase, Toyo Jozo lipase and Diosynth lipase (Trade Marks).

Amylase can for example be used in an amount in the range about 1 to about 100 MU (maltose units) per gram of detergent composition, (or 0.014–1.4 KNU/g (Novo units)). A preferred form of amylase is that sold as Termamyl (trade mark) ex Novo/Nordisk.

Cellulase can for example be used in an amount in the range about 0.3 to about 35 CEVU units per gram of the detergent composition. A preferred form of cellulase is that sold as Celluzyme (trade mark) ex Novo/Nordisk.

Genetic engineering of any of the above-mentioned enzymes can be achieved e.g. by extraction of an appropriate gene, and introduction and expression of the gene or derivative thereof in a suitable producer organism.

EP-A-130 756 (Genentech), EP-A-214 435 (Henkel), WO-A-87/04461 (Amgen), WO-A-87/05050 (Genex), EP-A-405 901 (Unilever) and EP-A-303 761 (Genentech) describe useful modified subtilisin proteases. Useful modified lipase enzymes are also described in for example WO-A-89/09263 (Gist-Brocades), EP-A-218 272 (Gist-Brocades), EP-A-258 068 (Novo/Nordisk), EP-A-407 225 (Unilever) and EP-A-305 216 (Novo/Nordisk).

Stabilizer

It is within the scope of the present invention to incorporate stabilizing systems for the enzymes, and for this purpose it is possible to use the measures set out in the specifications acknowledged by number above in connection with enzyme stabilization (which are specifically incorporated herein by reference).

For instance, there may be included a quantity of an enzyme-stabilizing system e.g. selected from (a) an enzyme-stabilizing system comprising calcium and formate or acetate, and (b) a polyol-and-borate-containing enzyme-stabilizing system.

Polyol at 2–25% w/w, e.g. glycerol or propylene glycol or other polyol, with sodium borate or borax at 2–15% w/w, may be used e.g. in compositions formulated according to EP-A-080 223 (Unilever) (incorporated herein by reference).

In addition or alternatively, low-molecular weight mono carboxylates (in salt or acid form) such as formate or acetate (0.1–10%), enzyme accessible calcium ions (0.1–1 mmole/kg) and lower alcohols e.g. ethanol or propylene glycol (up to 20%), may be used e.g. in compositions formulated according to EP-A-028 865 (Procter & Gamble) (incorporated herein by reference).

It can be quite acceptable to use lesser quantities of these stabilizers than those pointed out by the above-cited specifications.

Optional Components

In addition to the essential ingredients described hereinbefore, the preferred compositions herein frequently contain a series of optional ingredients which are used for the known functionality in conventional levels. While the inventive compositions are premised on aqueous enzyme-containing detergent compositions, it is frequently desirable to use a phase regulant. This component together with water constitutes then the solvent matrix for the claimed liquid compositions. Suitable phase regulants are well-known in liquid detergent technology and, for example, can be represented by hydrotropes such as salts of alkyl arylsulphonates having up to 3 carbon atoms in the alkylgroup, e.g., sodium, potassium, ammonium and ethanolamine salts of xylene-, toluene-, ethylbenzene-, cumene-, and isopropylbenzene sulphonic acids. Alcohols may also be used as phase regulants. This phase regulant is frequently used in an amount from about 0.5% to about 20%, the sum of phase regulant and water is normally in the range from 35% to 65%.

The preferred compositions herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

The beneficial utilization of the claimed compositions under various usage conditions can require the utilization of a suds regulant. While generally all detergent suds regulants can be utilized, preferred for use herein are alkylated polysiloxanes such as dimethylpolysiloxane also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The compositions herein can also contain known antioxidants for their known utility, frequently radical scavengers in the art established levels, i.e. 0.001% to 0.25% (by reference to total composition). These antioxidants are frequently introduced in conjunction with fatty acids.

Another optional ingredient which may be used particularly in structured liquids, is a deflocculating polymer. In general, a deflocculating polymer comprises a hydrophobic backbone and one or more hydrophobic side chains, as described in EP A-346 995 (Unilever) or in our copending U.S. patent application Ser. No. 664,513 (incorporated herein by reference). They allow, if desired, the incorporation of greater amounts of surfactants and/or electrolytes than would otherwise be compatible with the need for a stable, low-viscosity product as well as the incorporation, if desired, of greater amounts of other ingredients to which lamellar dispersions are highly stability-sensitive.

The deflocculating polymer generally will comprise, when used, from about 0.1 to about 5% of the composition, preferably 0.1 to about 2% and most preferably, about 0.5 to about 1.5%.

Product pH

The pH of the liquid detergent compositions of the invention can be chosen at will from a wide range, e.g. from about pH 7 to about pH 12, e.g. a milder alkaline range from about pH 7.5 to about pH 9.5 or a stronger alkaline range from about pH 8.5 to about pH 11.5, preferably from above 8.5 to 11, and most preferably from 9 to 10.5.

The following examples are intended to illustrate the invention and facilitate its understanding and are not meant to limit the invention in any way.

In the Examples the following abbreviations will be used:

LAS Linear C12-alkyl benzene sulphonic acid

LES Lauryl ether (3EO) sulphate

Nonionic Ethoxylated C12–C15 fatty alcohol

EXAMPLES 1–7

The following liquid detergent compositions were prepared:

| (% w/w) | 1 | 2 | 3 | 4 | 5 | 6 | 7 |
|---|---|---|---|---|---|---|---|
| LAS | 6.7 | 23 | 21 | 26.2 | 16.5 | 16.5 | 26.2 |
| Soap | — | — | — | — | 4.5 | 4.5 | — |
| Nonionic | 4.8 | 10 | 9 | 12 | 9 | 9 | 12 |
| Citric Acid.0aq | — | — | — | — | 8.2 | 9 | 7.5 |
| Na-citrate.2aq | 3.5 | 16.5 | 10.4 | 10 | — | — | — |
| Zeolite | 20 | — | — | — | 18.8 | 18.8 | — |
| Na-perborate.4aq | — | — | 20 | — | — | — | — |
| Deflocculating polymer | — | 1 | 1 | 1 | 1 | 1 | 1 |
| Calcium chloride.2aq | — | — | — | — | — | — | 0.2 |
| Triethanolamine | — | — | — | 2 | — | — | 2 |
| Monoethanolamine | — | — | — | 2 | — | — | 2 |
| Glycerol | — | — | — | — | 2 | — | 5 |
| Borax.10aq | — | — | 1.8 | — | 1.5 | — | 3.5 |
| Protease | 0.7 | 1.5 | 1.0 | 1.5 | 1.5 | 1.5 | 1.5 |
| Lipase | — | — | 0.5 | — | 0.5 | 0.5 | 0.5 |
| Minors and water | | | | ad 100% | | | |
| pH | 8.5 | 8.5 | 9.5 | 9.3 | 8.5 | 8.5 | 9.5 |

The liquid compositions were prepared according to the technique disclosed in EP-A-346 995 and the deflocculating polymer corresponds to polymer All of that specification. The protease was 16.0 LDX Durazym (ex Novo/Nordisk), a mutant subtilisin protease containing a glutamic acid residue at position 195 and an alanine residue at position 222. The protease was admixed in the liquid formulations as indicated. The lipase was Lipolase 100L (ex Novo/Nordisk). Lipolase is obtained by cloning the lipase gene from *Humicola lanuginosa* and expressing this gene in an *Aspergillus oryzae* host.

The storage stability of the protease in the compositions was determined by measuring protease activity as a function of storage time at 37° C. Half-lives were determined by plotting Ao/At versus time and performing non-linear regression analysis. The results are shown in Table A (in days at 37° C.). The storage stability of Lipolase 100L in the compositions 3 and 5–7 was also determined. The storage stability was determined by measuring lipase activity as a function of storage time at 37° c. The stability is given in Table B and is expressed as half-lives (in days at 37° C.).

Comparative Examples A–G

For comparison, the storage stability was also measured for the same compositions as in Examples 1–7, but containing native subtilisin enzyme as protease. Savinase 16.0 LDX (ex Novo/Nordisk) was admixed in the liquid formulations at the same proteolytic activity as the Durazym above. The half-lives were determined (in days at 37° C.). The results are shown in Table A. The storage stability of Lipolase 100L (ex Novo/Nordisk) in the compositions 3 and 5–7 was also determined. The stability is given in Table B and is indicated in half-lives (in days at 37° C.).

TABLE A

Half-life of protease activity at 37° C. (days)

| | Compositions of Example: | | | | | | |
|---|---|---|---|---|---|---|---|
| Proteolytic Enzyme: | 1 | 2 | 3 | 4 | 5 | 6 | 7 |
| Durazym | 6 | 30 | 7 | 20 | >>28[1]) | 60 | >>28 |
| Savinase | 4 | 3 | 2 | 1 | >>28[2]) | 8 | 2.5 |

[1])The residual activity after 28 days storage was 95%

[2])The residual activity after 28 days storage was 76%

These results show that the half-life of the protease activity for the detergent compositions containing a mutant protease are always higher than when native subtilisin protease is used. For the compositions of Example 3 which contain a bleach system, the improvement is about a factor 3. In the absence of bleach (examples 1–2 and 4–7), the improvement factor was in some cases 10.

TABLE B

Half-life of lipase activity at 37° C. (days)

| | Compositions of Example: | | | |
|---|---|---|---|---|
| Proteolytic Enzyme: | 3 | 5 | 6 | 7 |
| Durazym | 4.5 | >>28 | 28 | 3 |
| Savinase | 1.0 | 17 | 2.5 | 0.5 |

These results show that the half-life of the lipase activity for the detergent compositions containing a mutant protease are always higher than when native subtilisin protease is used.

EXAMPLES 8–10

The following liquid detergent compositions were prepared:

| (% w/w) | 8 | 9 | 10 |
|---|---|---|---|
| LAS | 10.0 | 27.3 | 10.0 |
| LES | 6.0 | — | 6.0 |
| Nonionic.9EO | 8.0 | 12.0 | 8.0 |
| Ethanol | 5.0 | — | — |
| Citric Acid.0aq | 3.2 | 7.1 | — |
| Na-citrate.2aq | — | — | 7.0 |
| Deflocculating polymer[1])(33%) | — | 3.1 | — |
| Calcium chloride | — | — | 0.01 |
| Triethanolamine | — | — | 2.0 |
| Monoethanolamine | — | 0.05 | 2.0 |
| Sorbitol (70%) | 4.5 | 5.0 | — |
| Glycerol | 2.7 | 5.0 | — |
| NaOH (50%) | — | 16.6 | — |
| Sodium xylene sulphonate | — | — | 3.0 |
| Borax.10aq | 4.0 | 8.0 | — |
| Protease | 1.5 | 0.6 | 0.75 |
| Lipase | 0.5 | 1.1 | — |
| Minors and water | | ad 100% | |
| pH | 7.2 | 8.7 | 10.1 |

[1])Copolymer of sodium acrylate and lauryl methacrylate, molecular weight 4,000–11,000 (Narlex DC-1 ex National Starch)

The protease was again 16.0 LDX Durazym and the lipase was Lipolase 100L (both ex Novo/Nordisk). The storage stability of the protease in the compositions was determined by measuring protease activity as a function of storage time at 37° C., as described above. The results are shown in Table C (in days at 37° C.). The storage stability of Lipolase 100L in the compositions 8 and 9 was also determined. The storage stability was determined by measuring lipase activity as a function of storage time at 37° C. The stability is given in Table D and is expressed as half-lives (in days at 37° C.).

Comparative Examples H–J

For comparison, the storage stability was also measured for the same compositions as in Example 10, but containing native subtilisin enzyme as protease. Savinase 16.0 LDX (ex Novo/Nordisk) was admixed in the liquid formulations at the same proteolytic activity as the Durazym above. The half-lives were determined (in days at 37° C.). The results are shown in Table C. The storage stability of Lipolase 100L (ex Novo/Nordisk) in the comparative compositions 8 and 9 was also determined. The stability is given in Table D and is indicated in half-lives (in days at 37° C.).

TABLE C

| Half-life of protease activity at 37° C. (days) | | | |
|---|---|---|---|
| | Compositions of Example: | | |
| Proteolytic Enzyme: | 8 | 9 | 10 |
| Durazym | — | — | 8 |
| Savinase | — | — | 5 |

These results show that the half-life of the protease activity for the detergent compositions containing a mutant protease are always higher than when native subtilisin protease is used.

TABLE D

| Half-life of lipase activity at 37° C. (days) | | |
|---|---|---|
| | Compositions of Example: | |
| Proteolytic Enzyme: | 8 | 9 |
| Durazym | 40 | >90 |
| Savinase | 29 | 49 |

These results show that the half-life of the lipase activity for the detergent compositions containing a mutant protease are always higher than when native subtilisin protease is used.

EXAMPLE 11

The following liquid detergent composition was prepared:

| (% w/w) | | 11 |
|---|---|---|
| Nonionic surfactant[1]) | | 2.0 |
| Na-citrate.2aq | | 15.0 |
| Glycerol | | 4.0 |
| Borax | | 2.7 |
| Carbopol 940 | | 1.2 |
| Clay (Laponite XLS) | | 0.02 |
| NaOH (50%) | | 2.0 |
| Sodium carbonate | | 5.0 |
| Sodium bicarbonate | | 5.0 |
| Protease | to give 14 GUmg | |
| Amylase | to give 38 MU/g | |
| Water | ad 100% | |
| pH | 9.9 | |

[1])PO—EO block copolymer having an $C_6$–$C_{10}$ alkyl group and a molecular weight of about 1,800; available as SLF-18

The protease was 16.0 LDX Durazym and the amylase was Termamyl (both ex Novo/Nordisk). The storage stability of the amylase in the composition was determined by measuring the remaining amylase activity after 21 days storage at 37° C. The results are shown in Table E.

Comparative Example K

For comparison, the storage stability was also measured for the same composition of Example 11, but containing native subtilisin enzyme as protease. Savinase 16.0 LDX (ex Novo/Nordisk) was admixed in the liquid formulation at the same proteolytic activity as the Durazym above. The storage stability of the amylase in the compositions was also determined by measuring the remaining amylase activity after 21 days storage at 37° C. The stability is given in Table E.

TABLE E

| % amylase activity after 21 days at 37° C. | |
|---|---|
| Proteolytic Enzyme: | |
| Durazym | 73 |
| Savinase | 51 |

These results show that the half-life of the amylase activity for the detergent compositions containing a mutant protease is always higher than when native subtilisin protease is used.

We claim:

1. An aqueous enzymatic detergent composition having improved storage stability comprising:

(a) from about 5 to about 65% by weight of a surfactant system wherein said surfactant system comprises a mixture of:

(i) anionic surfactants selected from the group consisting of the salts of $C_9$–$C_{20}$ alkylarylsulfonates; $C_8$–$C_{22}$ primary or secondary sulphonates: $C_8$ to $C_{24}$ olephinsulfonates; sulfonated carboxylic acids; $C_8$–$C_{22}$ alkylslphates; $C_8$–$C_{24}$ alkylpolyglycolether sulphates, carboxylates and phosphates; and mixture thereof; and (ii) a non-anionic surfactant selected from the group consisting of nonionic surfactant, cationic surfactant, amphoteric surfactant, zwitterionic surfactant and mixtures thereof;

the ratio of anionic to non-anionic being grater than 1:1, (b) a mutant subtilisin enzyme in which the amino acid sequence has been changed at least at positions 195 and 222 by substitution with another amino acid, said enzyme being added in sufficient quantity to have an activity level of 0.01 to 200,000 GU/g;

(c) lipase enzyme having an activity of 10 to 30:000 LU/g; and (d) optionally additionally comprising an enzyme selected from the group consisting of amylases and cellulase, said composition being essentially free from bleaching agents.

2. A composition according to claim 1, whereby in the mutant subtilisin enzyme the methionine residue at position 222 has been substituted with alanine.

3. A composition according to claim 1, whereby the glycine residue at position 195 has been substituted with glutamic acid.

4. A composition according to claim 1, wherein the aqueous composition is a structured liquid and further comprises 5 to 35% by weight of a builder.

5. A composition according to claim 1, wherein the aqueous enzymatic composition is an unstructured liquid and further comprises 3 to 10% by weight of a builder.

6. A composition according to claim 1, further comprising from about 0.1 to about 5% of a deflocculating polymer.

7. Process for preparing an aqueous liquid enzymatic detergent composition according to claim 1, wherein the mutant subtilisin enzyme is added in the form of a slurry of the enzyme in liquid nonionic surfactant.

* * * * *